US009506240B1

(12) United States Patent
Winter

(10) Patent No.: US 9,506,240 B1
(45) Date of Patent: Nov. 29, 2016

(54) DOME STRUCTURE WITH SQUARE AND HOMOGENEOUS ELEMENTS

(71) Applicant: Adam Zachary Winter, Lynnwood, WA (US)

(72) Inventor: Adam Zachary Winter, Lynnwood, WA (US)

( * ) Notice: Subject to any disclaimer, the term of this patent is extended or adjusted under 35 U.S.C. 154(b) by 0 days.

(21) Appl. No.: 15/081,842

(22) Filed: Mar. 26, 2016

(51) Int. Cl.
*E04B 1/32* (2006.01)

(52) U.S. Cl.
CPC ..... *E04B 1/3211* (2013.01); *E04B 2001/327* (2013.01); *E04B 2001/3276* (2013.01)

(58) Field of Classification Search
CPC ..... E04B 1/3211; E04B 2001/3294; E04B 7/105; E04B 2001/327; E04B 2001/3276
USPC ..... 52/81.1, 81.2, 81.3, 81.4, 81.5
See application file for complete search history.

(56) References Cited

U.S. PATENT DOCUMENTS 2,682,235 A 6/1954 Fuller
2,918,992 A * 12/1959 Gelsavage ..... E04B 1/3211 135/87
3,114,176 A 12/1963 Miller
3,333,375 A 8/1967 Johnston
3,530,620 A 9/1970 Heieren
3,810,336 A * 5/1974 Sadao ..... E04B 1/3211 52/81.2
3,925,940 A * 12/1975 O'Connell, Jr. ..... E04B 1/3211 52/81.1
3,977,138 A * 8/1976 Chastain ..... E04B 1/3211 52/81.4
4,009,543 A 3/1977 Smrt
4,146,997 A * 4/1979 Diethorn ..... E04B 1/3211 52/236.2
4,263,758 A * 4/1981 Seaich ..... E04B 1/3211 52/81.1
4,422,267 A * 12/1983 Whitehouse ..... E04B 1/3211 52/81.1
4,425,740 A * 1/1984 Golden ..... E04B 1/3211 16/225
4,608,789 A 9/1986 Willis
4,611,441 A 9/1986 Wickens
4,665,665 A * 5/1987 Wilkinson ..... E04B 1/3211 52/81.4
4,679,361 A * 7/1987 Yacoe ..... E04B 1/3211 52/81.1
5,732,514 A * 3/1998 Organ ..... E04B 1/3211 52/80.1
5,996,288 A * 12/1999 Aiken ..... E04B 1/3211 403/171
9,103,110 B1 * 8/2015 Gerber ..... E04B 1/3211

* cited by examiner

*Primary Examiner* — Beth Stephan

(57) ABSTRACT

A dome structure that is comparable to a 3V geodesic dome, but only requires two strut lengths. Therefore, it can be fabricated by producing just one triangular frame, 52 times. The 52 triangle frames fasten directly to each other with simple fasteners. No hubs, or special brackets are required. Furthermore, the footprint of the dome easily fits to a square support, and is even on both axes. In the case where hubs and/or brackets are used to connect struts, the variation in the angles by which the struts extend from the hubs is also reduced to just two.

6 Claims, 13 Drawing Sheets

DOME STRUCTURE WITH SQUARE AND HOMOGENEOUS ELEMENTS

CROSS REFERENCE TO RELATED APPLICATIONS

Not applicable.

FEDERALLY SPONSORED R/D

Not applicable.

REFERENCE TO APPENDIX

Not applicable.

BACKGROUND

Geodesic dome structures have many great qualities, but also some challenges with implementation. First of all, the footprint of any standard icosahedra dome is that of a pentagon or a hexagon (tending towards a circle with increased degree). Because of this, such domes do not utilize the space that they occupy efficiently. That is, it's difficult to place multiple domes in a close area without wasting space. Furthermore, geodesic domes have a height that is proportional to the width. So, if not made sufficiently large, the dome is not practical as a space enclosing structure, unless one mounts the dome on a secondary structure used to raise it and provide sufficient headroom. Finally, within the limits of a particular construction materials, there is a fundamental tradeoff between; variation in strut lengths and angles, and the size of the structure. That is, bigger domes are more complex.

DETAILED DESCRIPTION OF THE INVENTION

The invention is not a geodesic dome. Per Richard Buckminster Fuller (see U.S. Pat. No. 2,682,235 A, a "geodesic dome" pertains to the geometry of a sphere. However, the pattern utilized in this invention is not derived from a sphere. More specifically, this dome is not derived from a Platonic or Archimedean solid, which is the defining aspect of a geodesic structure. The two-dimensional footprint of this structure is even on both axes. This makes it more practical, compared to many geodesic domes, to fit the dome to a square base since the number of squinches, or pendentives, used is minimized. A person having ordinary skill in the art will appreciate that the structure can be expanded along said axes with relative simplicity. The variation in strut lengths and angles is reduced (compared to common geodesic domes, ex. 3V icosahedron dome) while the floor-area-to-strut-length ratio is kept relatively high. Lastly, certain struts form squares, or 90-degree angles, which lend themselves easily to standard doors and windows without the need for custom fabrication. In short, this is a relatively simple dome to construct, and lends itself to practical applications. In one embodiment, one can easily see that the triangle from FIG. 12. combines with itself to make a heptagon, and the spaces enclosed by the heptagons are square (rather than pentagonal). The squares form apertures in which a window can be easily fitted.

Figure 12:
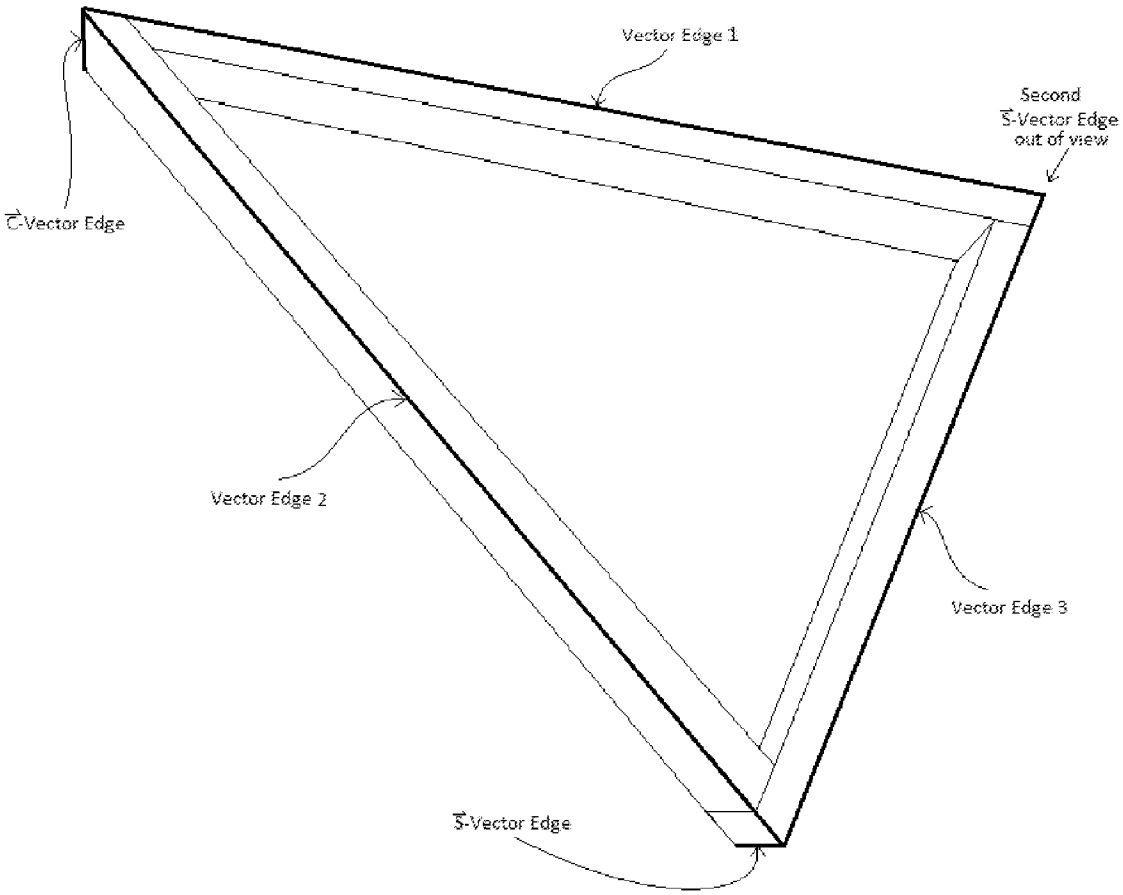
FIG. 12. is a single copy of the 52 triangle frames required construct the fundamental dome structure. All 52 frames are exact copies of each other (to the extent that the practitioner is capable). That is, only one kind of triangle frame is needed for the fundamental dome structure. The edges drawn in bold correlate to the vectors in FIG. 1 thru 8.

Using a material, such as wood, three members are produced and fastened together to create the triangle frame shown in FIG. 12. Simple fasteners, such as nails, screws, glue, or a combination thereof, is sufficient. A person having ordinary skill in the art will appreciate that said triangular frame may be constructed from any of a plurality of other materials and fastened with any of a plurality of other fasteners. Furthermore, a person having ordinary skill in the art will appreciate that said triangular frame may be produced as a unibody frame by means of injection molding, 3D printing or other process. FIG. 12: The edges of the frame which correspond to vectors in FIG. 1 thru 8 are drawn in bold and labeled. Dimensions of the members and frame are such that Vector Edge 1 is equal in length to Vector Edge 2, and 1.19897 times the length of Vector Edge 3. Additionally, the $\vec{S}$-Vector Edge and C-Vector Edge are such that, by FIG. 7, if $\theta_1$ is the angle between $\overrightarrow{-f_1}$ and $\vec{S}$, $\theta_2$ is the angle between $\vec{f}_2$ and $\vec{S}$, $\theta_3$ is the angle between $\vec{I}_0$ and $\vec{S}$, $\theta_4$ is the angle between $\vec{g}$ and $\vec{S}$, and, $\theta_5$ is the angle between $\vec{I}_1$ and $\vec{S}$, then, $\theta_1=\theta_2=\theta_3=\theta_4=\theta_5=101.61$ degrees, and, likewise the angles between $\vec{C}$ and each of $\vec{I}_3$ thru $\vec{I}_9$ are all equal to 106.025 degrees.

Figure 13:
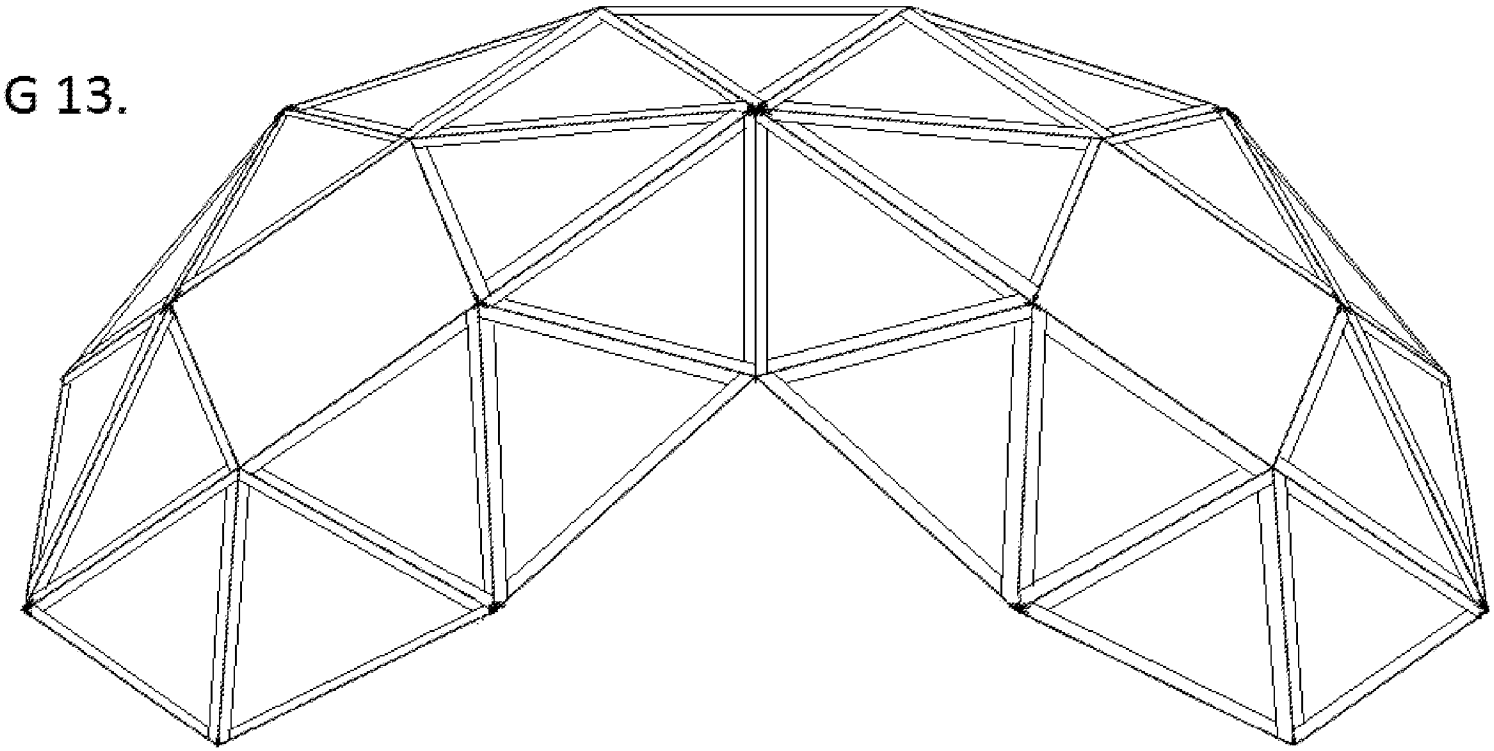
FIG. 13. Fundamental dome structure created by connecting 52 of the triangle frames from FIG. 12.

With 52 copies of the triangle frame from FIG. 12., one simply clamps the triangles to each other such that Vector Edge 1 is married with Vector Edge 2, and the seam between the two edges are the $\vec{1}$ vectors. As each pair of triangles are clamped to each other, in order to properly adjust the position, a simple fastener, such as a nail, screw, glue, bracket, tie-plate, or combination thereof, is used to permanently fasten the frames to each other. Continuing to do so according to the configuration dictated by the fundamental geometry shown in FIGS. 1 thru 3. results in the fundamental dome structure show in FIG. 13.

Figure 1:
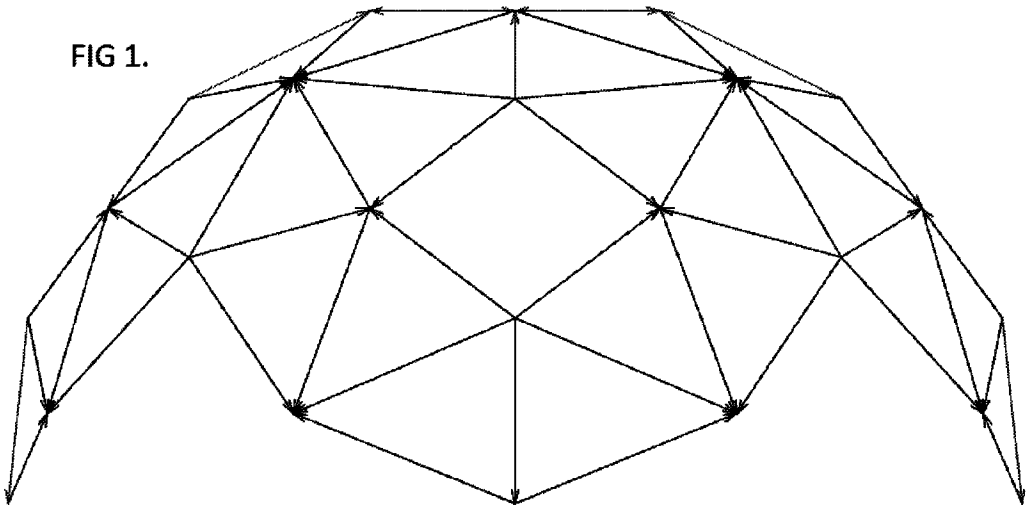
FIG. 1. is a side view of the vector representation of a structure that is the fundamental dome structure. The fundamental geometry of the structure is depicted using vectors as representations of where struts, or seams between struts, would be.
Figure 2:
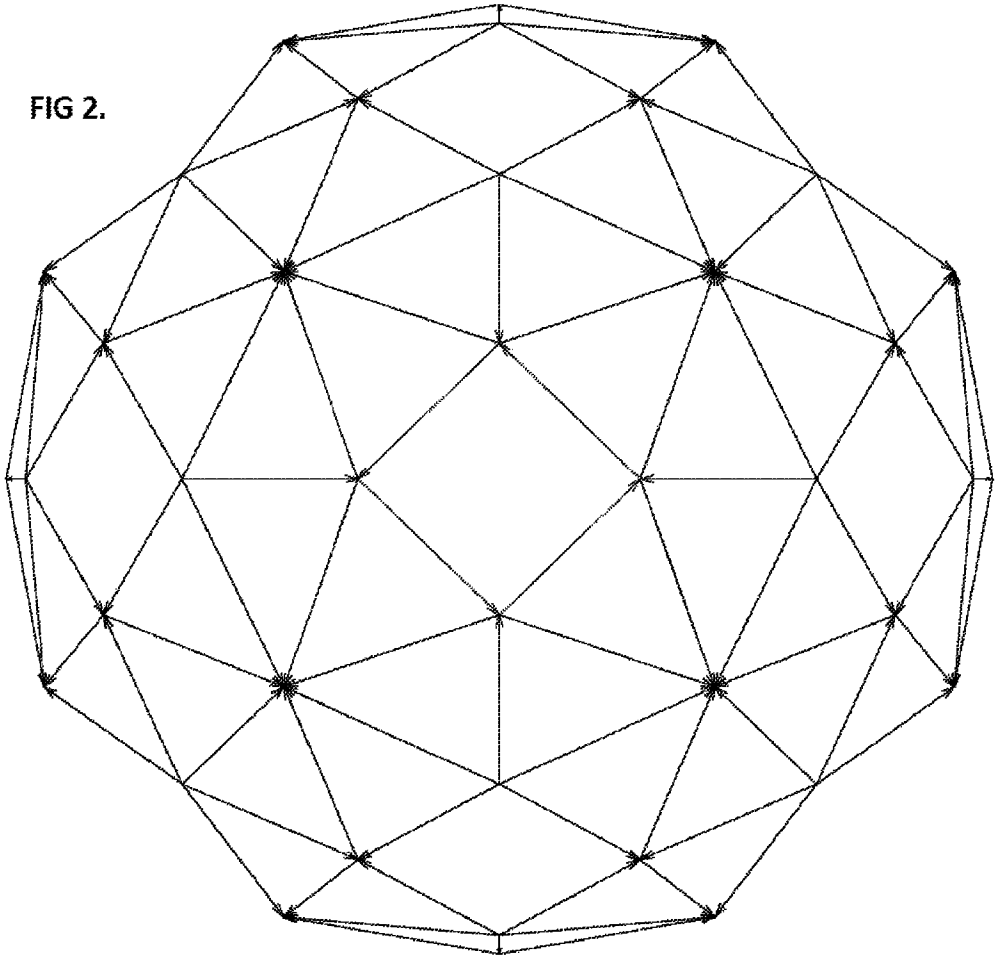
FIG. 2. is a top angle view of the fundamental dome structure.
Figure 3:
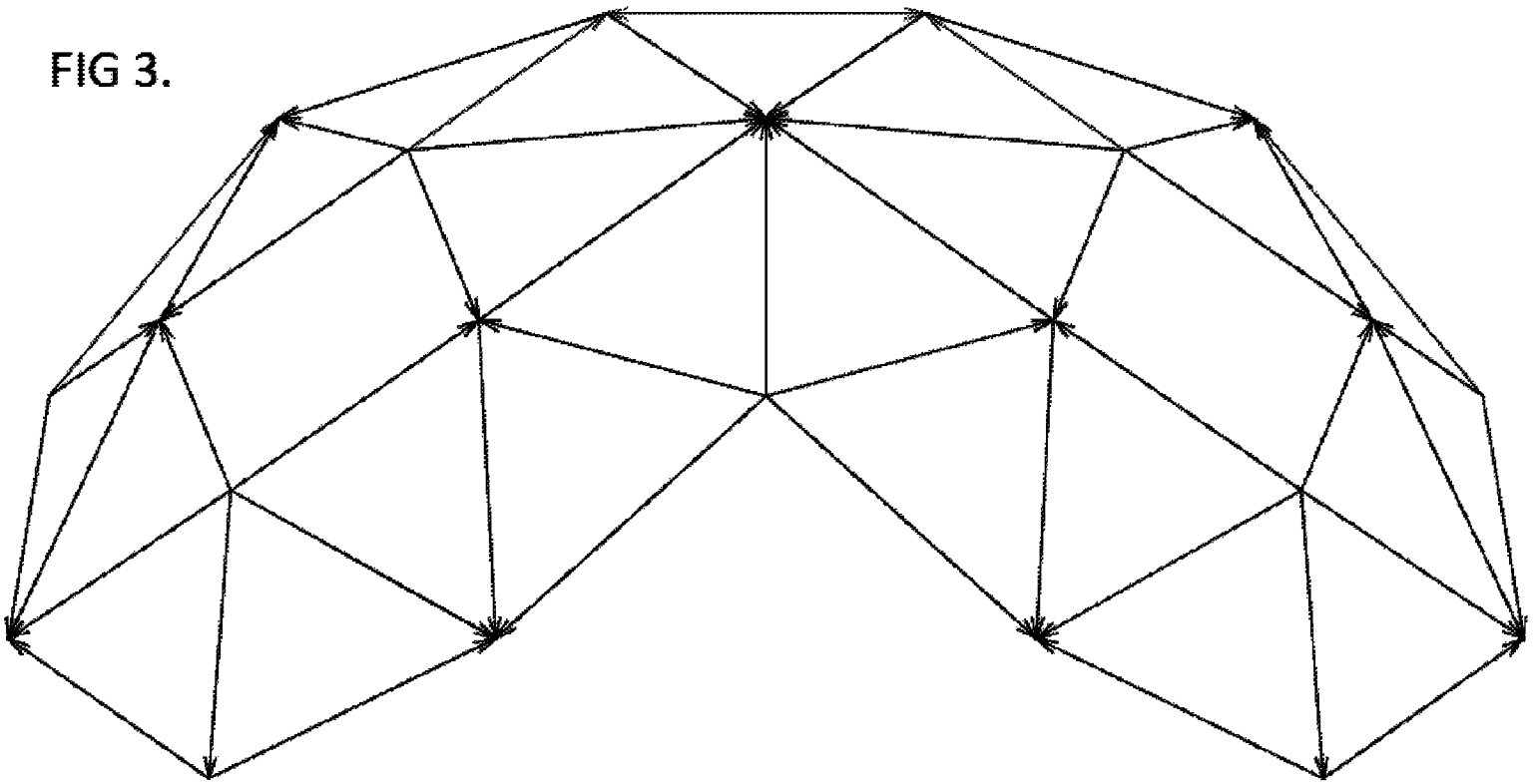
FIG. 3. is a side view of the fundamental dome structure; rotated 45 degrees from FIG. 1.
Figure 4:
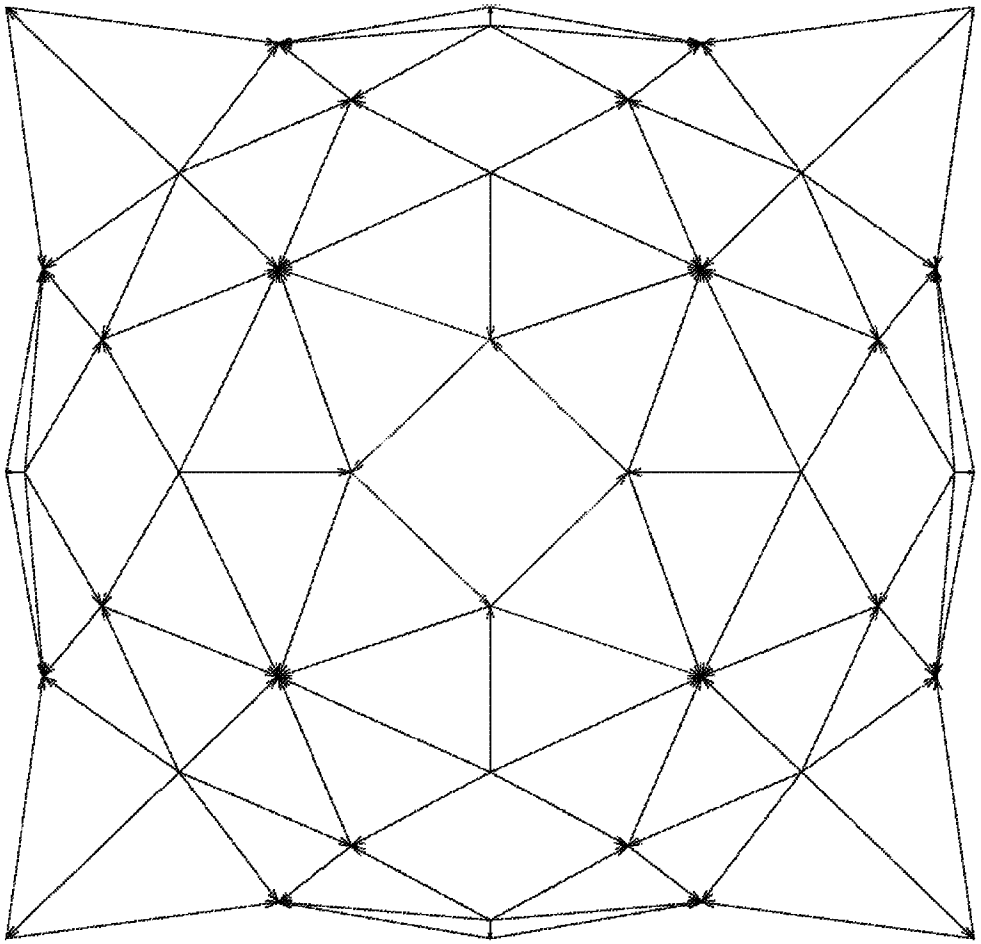
FIG. 4. is a top angle view of a structure which implements the fundamental dome structure and squinches.
Figure 5:
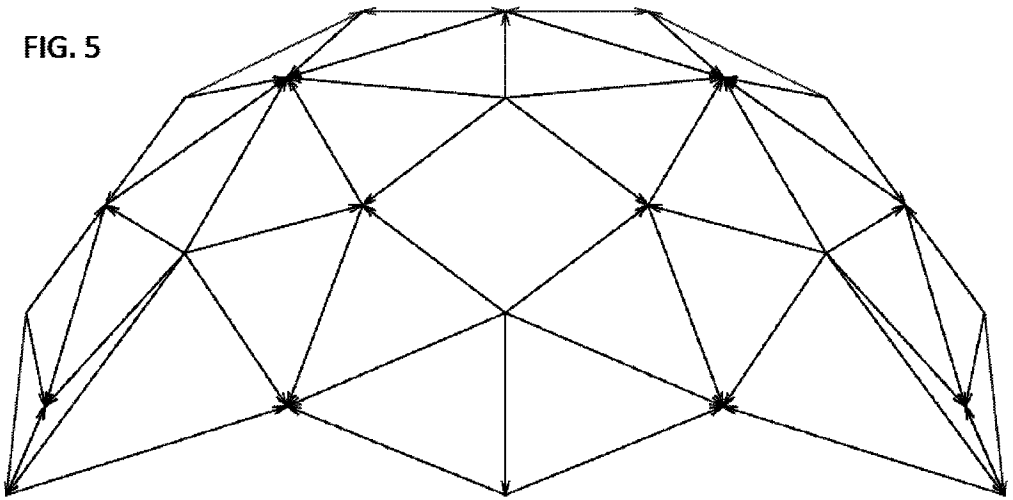
FIG. 5. is a side view of FIG. 4 depicting the basic geometrical arrangement in the use of squinches.
Figure 6:
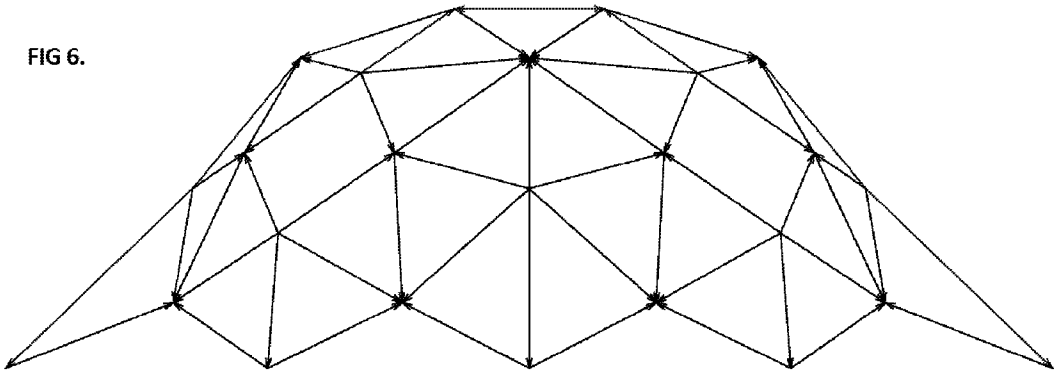
FIG. 6. is as FIG. 5 rotated by 45 degrees. The view of the fundamental dome portion is the same as FIG. 3.
Figure 7:
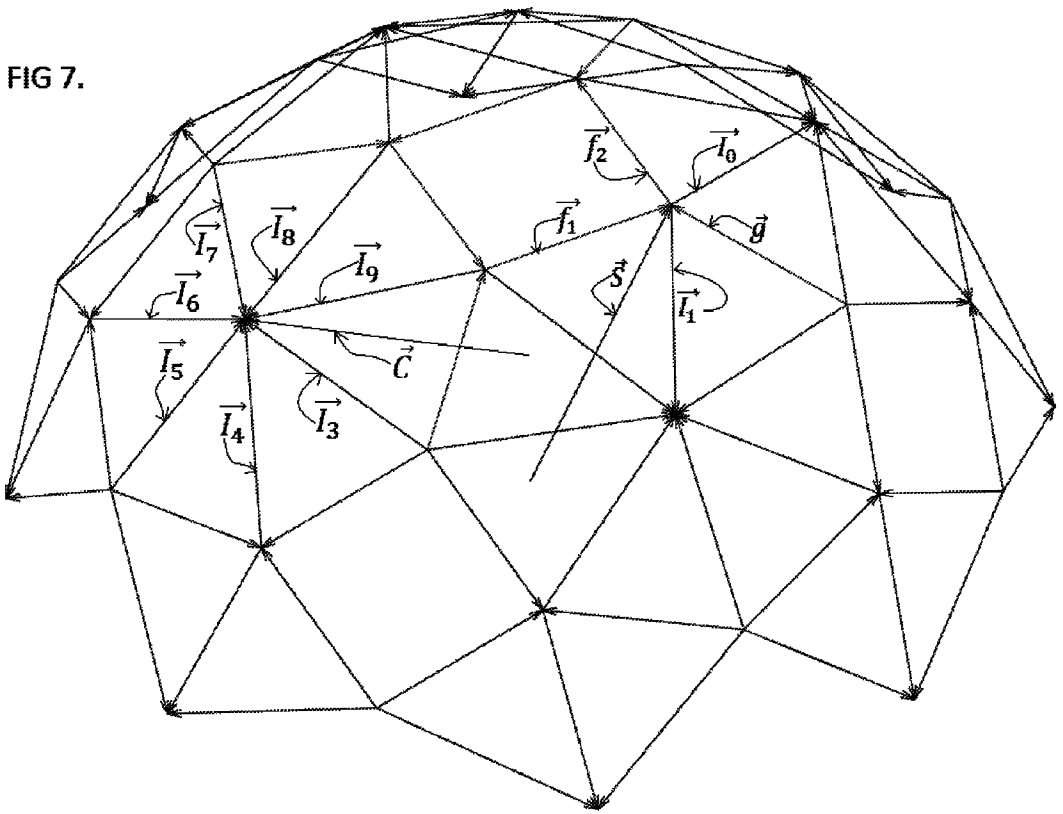
FIG. 7. locates vectors $\vec{f}_1$, $\vec{f}_2$, $\vec{I}_0$, $\vec{g}$, and $\vec{I}_1$ thru $\vec{I}_9$, and illustrates their angles with the vectors and $\vec{C}$.
Figure 8:
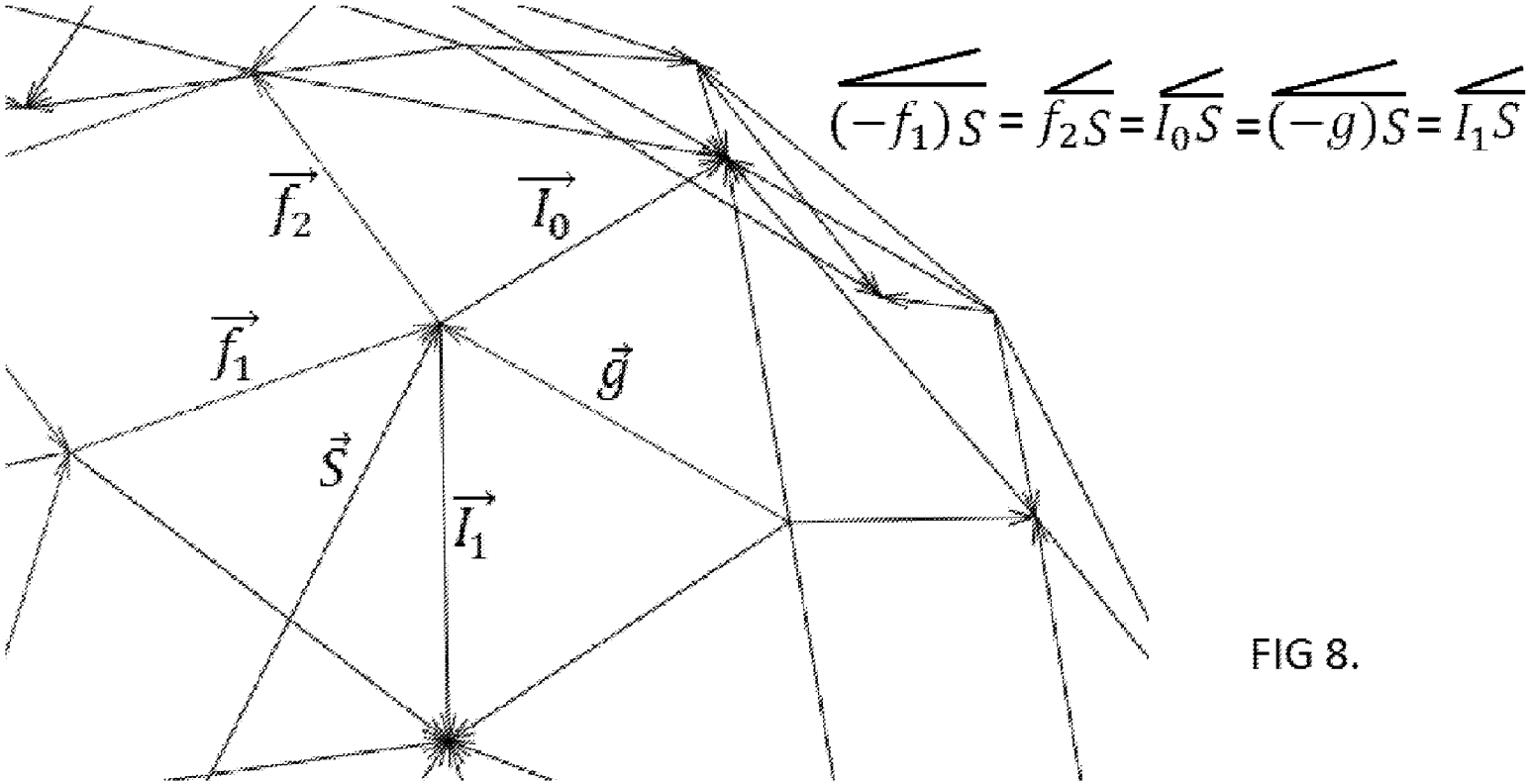
FIG. 8. is a close-up on the area located in FIG. 7, showing that the angle between $\vec{S}$ and each of the other vectors, individually, are all equal. That is, if $\theta_1$ is the angle between $\overrightarrow{-f_1}$ and $\vec{S}$, $\theta_2$ is the angle between $\vec{f}_2$ and $\vec{S}$, etc. . . . . Then, $\theta_1=\theta_2=\theta_3=\theta_4=\theta_5$.
Figure 9:
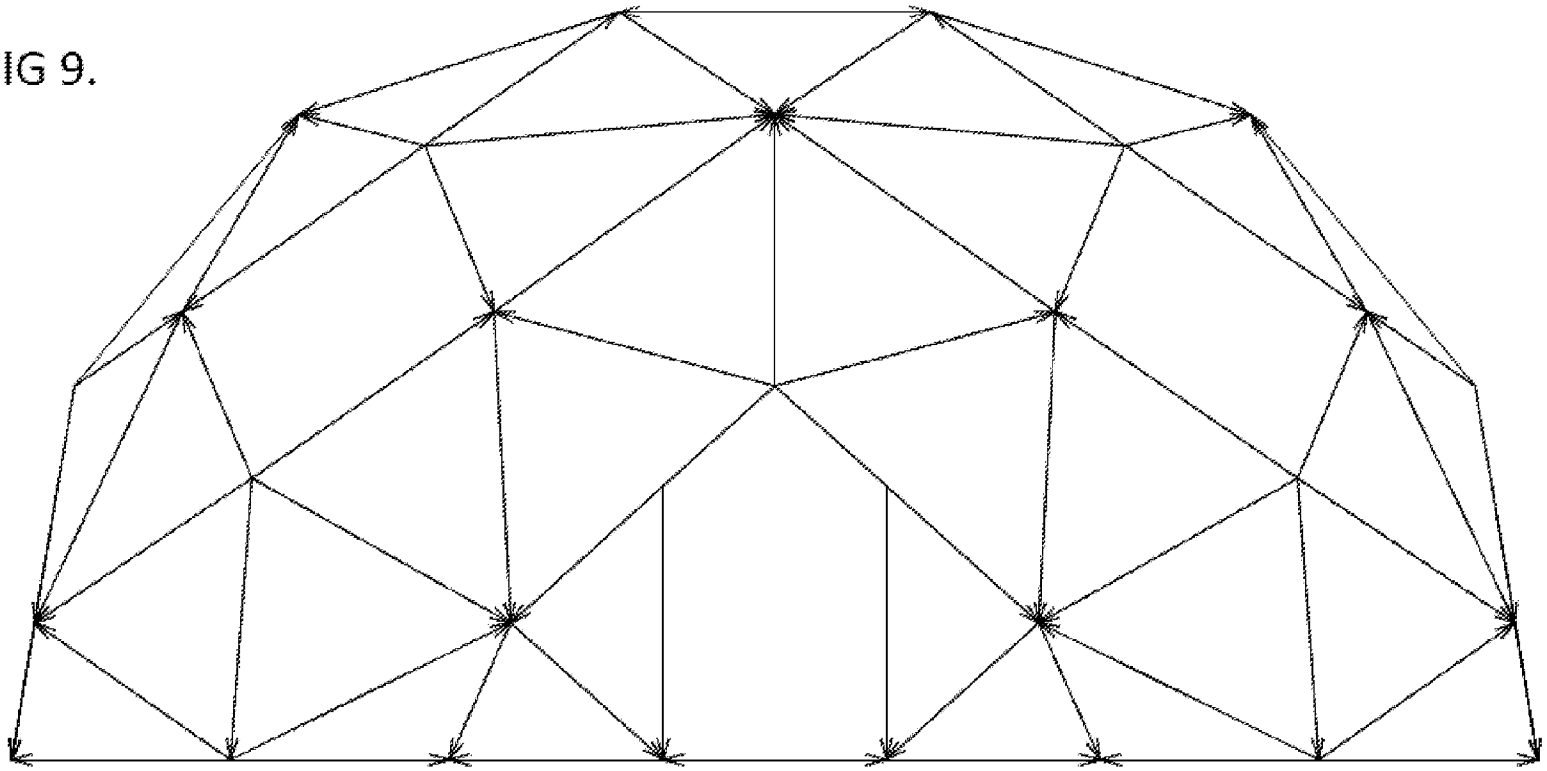
FIG. 9. is an implementation of the fundamental geometry without using squinches.
Figure 10:
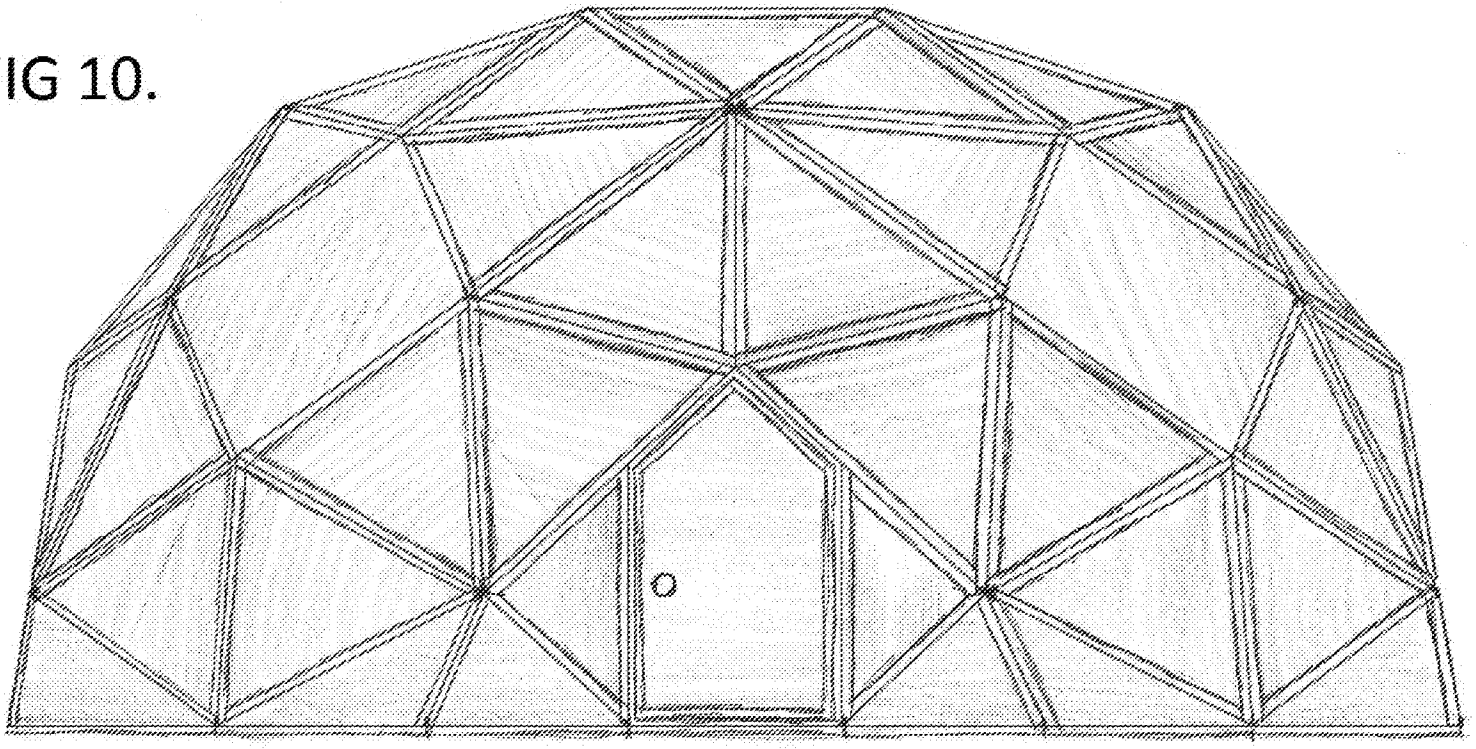
FIG. 10. is an example of the framework described by FIG. 9 applied to use as a greenhouse.
Figure 11:
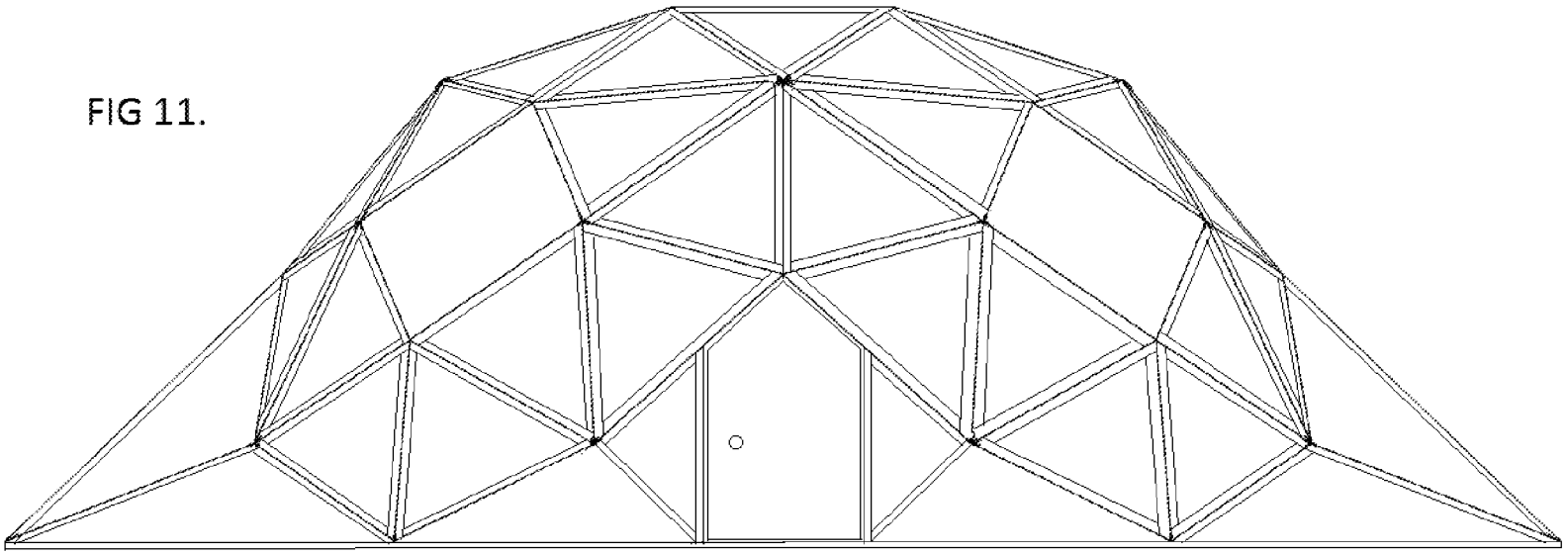
FIG. 11. is an example of a structural framework resulting from the configuration shown in FIG. 6. Struts could be made from any reasonable building materials and fastening methods. A multitude of possible uses for the framework exist.

Per the geometry shown in FIGS. 4, 5, and 6, the fundamental dome structure can then be extended such that the footprint of the structure becomes square, resulting in the structure shown in FIG. 11. However, a base that resembles something of a traditional geodesic dome can still be created, see FIG. 9. and FIG. 10, and many of the benefits of using the fundamental structure are still realized. Furthermore, a person having ordinary skill in the art will appreciate that a dome structure with said fundamental geometry may be constructed using connection hubs, or brackets, to connect individual struts at the connection points.

PRIOR ART

Many domes have been patented in various ways. At a glance, any one of them may appear to be the same structure as the proposed invention. However, all of those are specifically "geodesic" as defined by Richard Buckminster Fuller (see U.S. Pat. No. 2,682,235 A). The invention herein is not a geodesic dome. One can distinguish between the two by noticing that, with the icosahedra geodesic dome, there are two different triangles (see U.S. Pat. No. 3,114,176, which specifically refers to "triangle 1" and "triangle 2"). One of the triangles combines with itself to form a larger hexagon. The other combines with itself to form a pentagon. Thus, the footprint is either pentagonal or hexagonal.

There is one dome structure, however, that does use a larger heptagon with the intent of creating a square footprint (see U.S. Pat. No. 4,608,789). By simple visual inspection, one can easily see that the geometric configuration is very different.

The various triangular frames described in prior art are all specifically for "geodesic domes," use brackets or hubs to connect the members, use additional members for bracing, or assume a membrane covering installed in prefabrication. See (U.S. Pat. No. 3,530,620, U.S. Pat. No. 4,611,441, U.S. Pat. No. 4,009,543, U.S. Pat. No. 3,114,176 and U.S. Pat. No. 3,333,375). In any case, no prior art claims a triangular frame with these specific dimensions.

The invention claimed is:

1. A dome structure comprising:

a plurality of isosceles triangles;

said triangles having two sides each 1.19897 times the length of the third side;

said triangles being arranged such that 28 of said triangles combine to form 4 heptagons;

said heptagons being configured as to form a square aperture between them;

said heptagons as configured, forming a top of said dome structure;

said triangles further being arranged as to form a lower portion of said dome, arranged in groups of three, as to combine with said top to form four additional square apertures.

2. The dome structure of claim 1, wherein said triangles are made of wood.

3. The dome structure of claim 1, wherein said triangles are a unibody frame made of plastic.

4. The dome structure of claim 1, wherein said triangles are fastened by a fastening means.

5. The dome structure of claim 1, wherein said structure comprises, at most, 52 of said triangles.

6. The dome structure of claim 1, wherein said triangles are all identical in dimensions.

* * * * *